US011242642B2

(12) United States Patent
Stopponi

(10) Patent No.: US 11,242,642 B2
(45) Date of Patent: Feb. 8, 2022

(54) LAUNDRY TREATING APPLIANCE HAVING A TREATING CHEMISTRY DISPENSER

(71) Applicant: WHIRLPOOL CORPORATION, Benton Harbor, MI (US)

(72) Inventor: Andrea Stopponi, Matelica (IT)

(73) Assignee: Whirlpool Corporation, Benton Harbor, MI (US)

( * ) Notice: Subject to any disclaimer, the term of this patent is extended or adjusted under 35 U.S.C. 154(b) by 172 days.

(21) Appl. No.: 16/721,064

(22) Filed: Dec. 19, 2019

(65) Prior Publication Data

US 2021/0189632 A1 Jun. 24, 2021

(51) Int. Cl.

| | |
|---|---|
| ***D06F 39/02*** | (2006.01) |
| ***D06F 33/00*** | (2020.01) |
| ***D06F 39/00*** | (2020.01) |

(52) U.S. Cl.

CPC ..... *D06F 39/026* (2013.01); *D06F 33/00* (2013.01); *D06F 39/007* (2013.01)

(58) Field of Classification Search

CPC ..... A47L 15/44–449

See application file for complete search history.

(56) References Cited

U.S. PATENT DOCUMENTS

| | | | | |
|---|---|---|---|---|
| 9,637,856 | B2 | 5/2017 | Zattin et al. | |
| 9,663,892 | B2 | 5/2017 | Del Pos et al. | |
| 9,790,635 | B2 | 10/2017 | Del Pos et al. | |
| 9,790,636 | B2 | 10/2017 | Del Pos et al. | |
| 9,828,720 | B2 | 11/2017 | Del Pos et al. | |
| 9,903,062 | B2 | 2/2018 | Favaro et al. | |
| 9,976,248 | B2 | 5/2018 | Favaro et al. | |
| 2009/0322195 | A1* | 12/2009 | Joerger | D06F 39/02 312/334.1 |
| 2010/0000264 | A1* | 1/2010 | Luckman | D06F 33/00 68/4 |
| 2016/0178274 | A1* | 6/2016 | Shin | A47B 88/473 312/408 |
| 2017/0321369 | A1 | 11/2017 | Del Pos et al. | |
| 2017/0362763 | A1* | 12/2017 | Favaro | D06F 37/04 |
| 2018/0355542 | A1* | 12/2018 | Jiang | D06F 39/12 |
| 2019/0048508 | A1 | 2/2019 | Favaro et al. | |
| 2019/0078252 | A1 | 3/2019 | Driussi | |

FOREIGN PATENT DOCUMENTS

| | | | |
|---|---|---|---|
| CN | 103806256 | A * | 5/2014 |
| CN | 103924422 | A * | 7/2014 |
| EP | 1449951 | A1 | 8/2004 |

(Continued)

OTHER PUBLICATIONS

European Search Report for Counterpart EP20214391.3, dated Mar. 10, 2021, 6 Pages.

*Primary Examiner* — Michael E Barr
*Assistant Examiner* — Omair Chaudhri
(74) *Attorney, Agent, or Firm* — McGarry Bair PC

(57) ABSTRACT

A laundry treating appliance for treating laundry according to an automatic cycle of operation includes a cabinet defining an interior. A treating chamber is located within the interior. A dispenser is fluidly coupled to the treating chamber. The dispenser includes first and second drawers slidable along a slide path relative to the cabinet between opened and closed positions and having one or more treating chemistry chambers.

19 Claims, 10 Drawing Sheets

(56) References Cited

FOREIGN PATENT DOCUMENTS

| | | | | | |
|---|---|---|---|---|---|
| EP | 2381027 | B1 | | 9/2015 | |
| EP | 2003237 | B1 | | 5/2016 | |
| EP | 3221500 | A1 | | 9/2017 | |
| EP | 3221503 | A1 | | 9/2017 | |
| EP | 3234253 | A1 | | 10/2017 | |
| EP | 3315651 | A1 | | 5/2018 | |
| WO | 2016078717 | A1 | | 5/2016 | |
| WO | 2016078720 | A1 | | 5/2016 | |
| WO | 2016096009 | A1 | | 6/2016 | |
| WO | 2018103968 | A1 | | 6/2018 | |
| WO | WO-2018103968 | A1 | * | 6/2018 | ..... D06F 39/02 |

* cited by examiner

LAUNDRY TREATING APPLIANCE HAVING A TREATING CHEMISTRY DISPENSER

BACKGROUND

Laundry treating appliances, such as washing machines, combination washer/dryers, refreshers, and non-aqueous systems, can have a configuration based on a rotating laundry basket or drum that defines a drum opening and at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, can be supplied to the treating chamber in accordance with the cycle of operation. The laundry treating appliance can have a dispenser for loading of treating chemistries into the appliance by the user and for supplying various treating chemistries to the treating chamber.

BRIEF SUMMARY

In one aspect, the present disclosure relates to a laundry treating appliance for treating laundry according to an automatic cycle of operation, the laundry treating appliance comprising a cabinet defining an interior, a treating chamber located within the interior, and a dispenser fluidly coupled to the treating chamber and comprising a front drawer slidable along a slide path relative to the cabinet between opened and closed positions and having one or more treating chemistry chambers located across a width of the front drawer, and a rear drawer, located behind the front drawer, and slidable along the slide path between opened and closed positions and having one or more treating chemistry chambers located across a width of the rear drawer and located behind the treating chemistry chambers of the front drawer when the front drawer, wherein the front and rear drawers are independently slidable along the slide path and the front drawer blocks access to the rear drawer when the front drawer is in the closed position.

DETAILED DESCRIPTION

Figure 1:
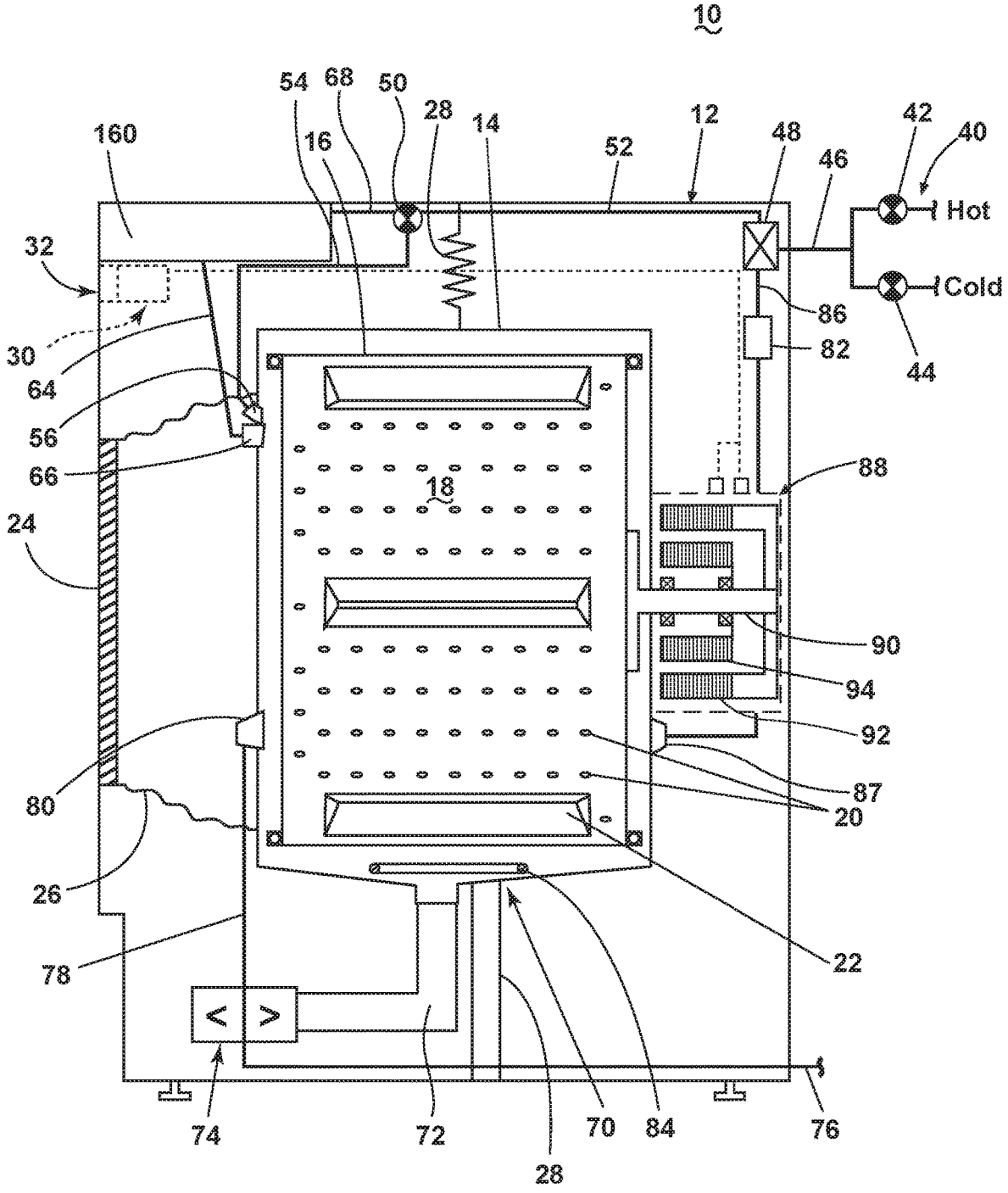
FIG. 1 is a schematic cross-sectional view of a laundry treating appliance.

FIG. 1 is a schematic cross-sectional view of a laundry treating appliance 10 according to an aspect of the present disclosure. The laundry treating appliance 10 can be any laundry treating appliance 10 which performs a cycle of operation to clean or otherwise treat laundry items placed therein, non-limiting examples of which include a horizontal or vertical axis clothes washer; a horizontal or vertical axis clothes dryer; a combination washing machine and dryer; a tumbling or stationary refreshing/revitalizing machine; an extractor; a non-aqueous washing apparatus; and a revitalizing machine. While the laundry treating appliance 10 is illustrated herein as a horizontal axis, front-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 can include a structural support assembly comprising a cabinet 12 which defines a housing within which a laundry holding assembly resides. The cabinet 12 can be a housing having a chassis and/or a frame, to which decorative panels can or cannot be mounted, defining an interior, enclosing components typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure.

The laundry holding assembly of the illustrated laundry treating appliance 10 can include a tub 14 dynamically suspended within the structural support assembly of the cabinet 12 by a suitable suspension assembly 28, the tub 14 at least partially defining a treating chamber 18 for laundry items. A rotatable drum 16 can be provided within the tub 14 to further define at least a portion of the laundry treating chamber 18. The treating chamber 18 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket.

The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It is also within the scope of the present disclosure for the laundry holding assembly to comprise only one receptacle, such as the tub 14 without the drum 16, or the drum 16 without the tub 14, with the single receptacle defining the laundry treating chamber 18 for receiving the load to be treated.

The laundry holding assembly can further include a closure, illustrated herein as a door assembly 24, which can be movably mounted to or coupled to the cabinet 12 to selectively close both the tub 14 and the drum 16, as well as the treating chamber 18. In one example, the door assembly 24 can be rotatable relative to the cabinet 12. By way of non-limiting example, the door assembly 24 can be hingedly coupled to the cabinet 12 for movement between an opened condition (not shown) and a closed condition as shown.

A bellows 26 can extend between the tub 14 and the cabinet 12 to couple an open face of the tub 14 with the cabinet 12, with the door assembly 24 sealing against the bellows 26 or the cabinet 12, or both, when the door assembly 24 closes the tub 14. In the opened condition, the door assembly 24 can be spaced apart from the bellows 26 and can allow access to the treating chamber 18. The bellows 26 can sealingly couple the open face of the tub 14 with the cabinet 12 such that liquid is not permitted to move from the tub 14 into the interior of the cabinet 12.

The laundry treating appliance 10 can optionally further comprise a washing circuit which can include a liquid supply assembly for supplying liquid, such as water or a combination of water and one or more wash aids, such as detergent, to the laundry treating appliance 10 for use in treating laundry during a cycle of operation. The liquid supply assembly can include a source of water, such as a household water supply 40, which can include separate valves 42 and 44 for controlling the flow of hot and cold water, respectively. The valves 42, 44 can be opened individually or together to provide a mix of hot and cold water at a selected temperature. The valves 42, 44 are selectively openable to provide water, such as from the household water supply 40, to be supplied through an inlet conduit 46 directly to the tub 14 or the drum 16 by controlling first and second diverter mechanisms 48 and 50, respectively. The diverter mechanisms 48, 50 can each be a diverter valve having two outlets such that each of the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14 in a desired pattern and under a desired amount of pressure. For example, the spray nozzle 56 can be configured to dispense a flow or stream of water into the tub 14 by gravity, i.e. a non-pressurized stream. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The laundry treating appliance 10 can also optionally be provided with a dispensing assembly for dispensing treating chemistry to the treating chamber 18 for use in treating the laundry according to a cycle of operation. The dispensing assembly can include a treating chemistry dispenser 160 which can be a single dose dispenser, a bulk dispenser, or an integrated single dose and bulk dispenser and is fluidly coupled to the treating chamber 18. The treating chemistry dispenser 160 can be configured to dispense a treating chemistry directly to the tub 14 or mixed with water from the liquid supply assembly through a dispensing outlet conduit 64. The treating chemistry dispenser 160 can include means for supplying or mixing detergent to or with water from the water supply 40. Alternatively, or additionally, water from the water supply 40 can also be supplied to the tub 14 through the treating chemistry dispenser 160 without the addition of a detergent. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 160 from the supply conduit 52 by directing the diverter mechanism 50 to direct the flow of water to a dispensing supply conduit 68.

The treating chemistry dispenser 160 can include multiple chambers or reservoirs for receiving doses of different treating chemistries. The treating chemistry dispenser 160 can be implemented as a dispensing drawer that is slidably received within the cabinet 12, or within a separate dispenser housing which can be provided in the cabinet 12. The treating chemistry dispenser 160 can be moveable between a fill position, where the treating chemistry dispenser 160 is exterior to the cabinet 12 and can be filled with treating chemistry, and a dispense position, where the treating chemistry dispenser 160 is interior of the cabinet 12.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

The laundry treating appliance 10 can also include a recirculation and drain assembly for recirculating liquid within the laundry holding assembly and draining liquid from the laundry treating appliance 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can have an inlet fluidly coupled with the sump 70 and an outlet configured to fluidly couple and to direct liquid to a drain conduit 76, which can drain the liquid from the laundry treating appliance 10, or to a recirculation conduit 78, which can terminate at a recirculation inlet 80. In this configuration, the pump 74 can be used to drain or recirculate wash water in the sump 70. The recirculation inlet 80 can direct the liquid from the recirculation conduit 78 into the drum 16 by fluidly coupling the recirculation conduit 78 with the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry, can be recirculated into the treating chamber 18 for treating the laundry within. The recirculation and drain assembly can include other types of recirculation systems.

The liquid supply and/or recirculation and drain assembly can be provided with a heating assembly which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation. The sump heater 84 can be provided within the sump 70 to heat liquid that collects in the sump 70. Alternatively, the heating assembly can include an in-line heater that heats the liquid as it flows through the liquid supply, dispensing, and/or recirculation assemblies.

It is noted that the illustrated suspension assembly, liquid supply assembly, recirculation and drain assembly, and dispensing assembly are shown for exemplary purposes only and are not limited to the assemblies shown in the drawings and described above. For example, the liquid supply, dispensing, and recirculation and pump assemblies can differ from the configuration shown in FIG. 1, such as by inclusion of other valves, conduits, treating chemistry dispensers, heaters, sensors (such as water level sensors and temperature sensors), and the like, to control the flow of liquid through the laundry treating appliance 10 and for the introduction of more than one type of treating chemistry. For example, the liquid supply assembly can include a single valve for controlling the flow of water from the household water source. In another example, the recirculation and pump assembly can include two separate pumps for recirculation and draining, instead of the single pump as previously described. In yet another example, the liquid supply assembly can be configured to supply liquid into the interior of the drum 16 or into the interior of the tub 14 not occupied by the drum 16, such that liquid can be supplied directly to the tub 14 without having to travel through the drum 16.

The laundry treating appliance 10 also includes a drive assembly for rotating the drum 16 within the tub 14. The drive assembly can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used.

The motor 88 can rotationally drive the drum 16, including that the motor 88 can rotate the drum 16 at various speeds in either rotational direction. In particular, the motor 88 can rotate the drum 16 at tumbling speeds wherein the laundry items in the drum 16 rotate with the drum 16 from a lowest location of the drum 16 towards a highest location of the drum 16, but fall back to the lowest location of the drum 16 before reaching the highest location of the drum 16. The rotation of the laundry items with the drum 16 can be facilitated by the baffles 22. Typically, the force applied to the laundry items at the tumbling speeds is less than about 1G. Alternatively, the motor 88 can rotate the drum 16 at spin speeds wherein the laundry items rotate with the drum 16 without falling. The spin speeds can also be referred to as satellizing speeds or sticking speeds. Typically, the force applied to the laundry items at the spin speeds is greater than or about equal to 1G. As used herein, "tumbling" of the drum 16 refers to rotating the drum 16 at a tumble speed, "spinning" the drum 16 refers to rotating the drum 16 at a spin speed, and "rotating" of the drum 16 refers to rotating the drum 16 at any speed.

The laundry treating appliance 10 also includes a control assembly for controlling the operation of the laundry treating appliance 10 and its various working components to control the operation of the working components and to implement one or more treating cycles of operation. The control assembly can include a controller 30 located within the cabinet 12 and a user interface 32 that is operably coupled with the controller 30. The user interface 32 can provide an input and output function for the controller 30. In one example, the user interface 32 can be provided or integrated with the door assembly 24. In another example, as shown, the user interface 32 can be provided on a front panel of the cabinet 12.

The user interface 32 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 30 to communicate with the user in a variety of ways. For example, the controller 30 can be configured to send a text message to the user, send an electronic mail to the user, or provide audio information to the user either through the laundry treating appliance 10 or utilizing another device such as a mobile phone.

The controller 30 can include the machine controller and any additional controllers provided for controlling any of the components of the laundry treating appliance 10. For example, the controller 30 can include the machine controller and a motor controller. Many known types of controllers can be used for the controller 30. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
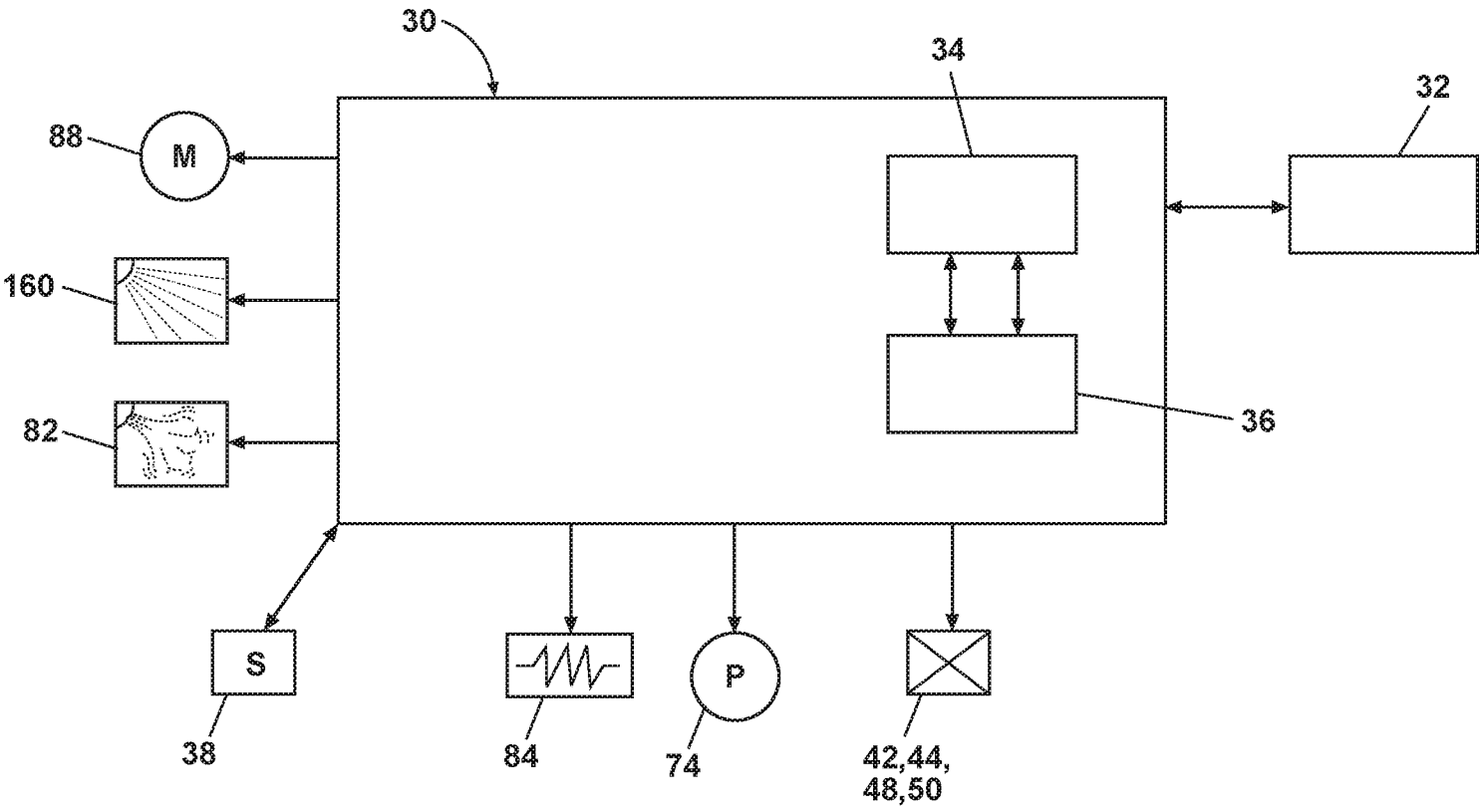
FIG. 2 is a schematic of a control assembly of the laundry treating appliance of FIG. 1.

As illustrated in FIG. 2, the controller 30 can be provided with a memory 34 and a central processing unit (CPU) 36. The memory 34 can be used for storing the control software that is executed by the CPU 36 in completing a cycle of operation using the laundry treating appliance 10 and any additional software. For example, the memory 34 can store a set of executable instructions including at least one user-selectable cycle of operation. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 32. The memory 34 can also be used to store information, such as a database or table, and to store data received from one or more components of the laundry treating appliance 10 that can be communicably coupled with the controller 30. The database or table can be used to store the various operating parameters for the one or more cycles of operation, including factory default values for the operating parameters and any adjustments to them by the control assembly or by user input.

The controller 30 can be operably coupled with one or more components of the laundry treating appliance 10 for communicating with and controlling the operation of the component to complete a cycle of operation. For example, the controller 30 can be operably coupled with the valves 42, 44 and the diverter mechanisms 48, 50 for controlling the temperature and flow rate of treating liquid into the treating chamber 18, the motor 88 for controlling the direction and speed of rotation of the drum 16, the pump 74 for controlling the amount of treating liquid in the treating chamber 18 or sump 70, the treating chemistry dispenser 160 for controlling the flow of treating chemistries into the treating chamber 18, the user interface 32 for receiving user selected inputs and communicating information to the user, the steam generator 82, and the sump heater 84 to control the operation of these and other components to implement one or more of the cycles of operation.

The controller 30 can also be coupled with one or more sensors 38 provided in one or more of the assemblies of the laundry treating appliance 10 to receive input from the sensors 38, which are known in the art and not shown for simplicity. Non-limiting examples of sensors 38 that can be communicably coupled with the controller 30 include: a treating chamber temperature sensor, such as a thermistor, which can detect the temperature of the treating liquid in the treating chamber 18 and/or the temperature of the treating liquid being supplied to the treating chamber 18, a moisture sensor, a weight sensor, a chemical sensor, a position sensor, an imbalance sensor, a load size sensor, and a motor torque sensor, which can be used to determine a variety of assembly and laundry characteristics, such as laundry load inertia or mass.

Figure 3:
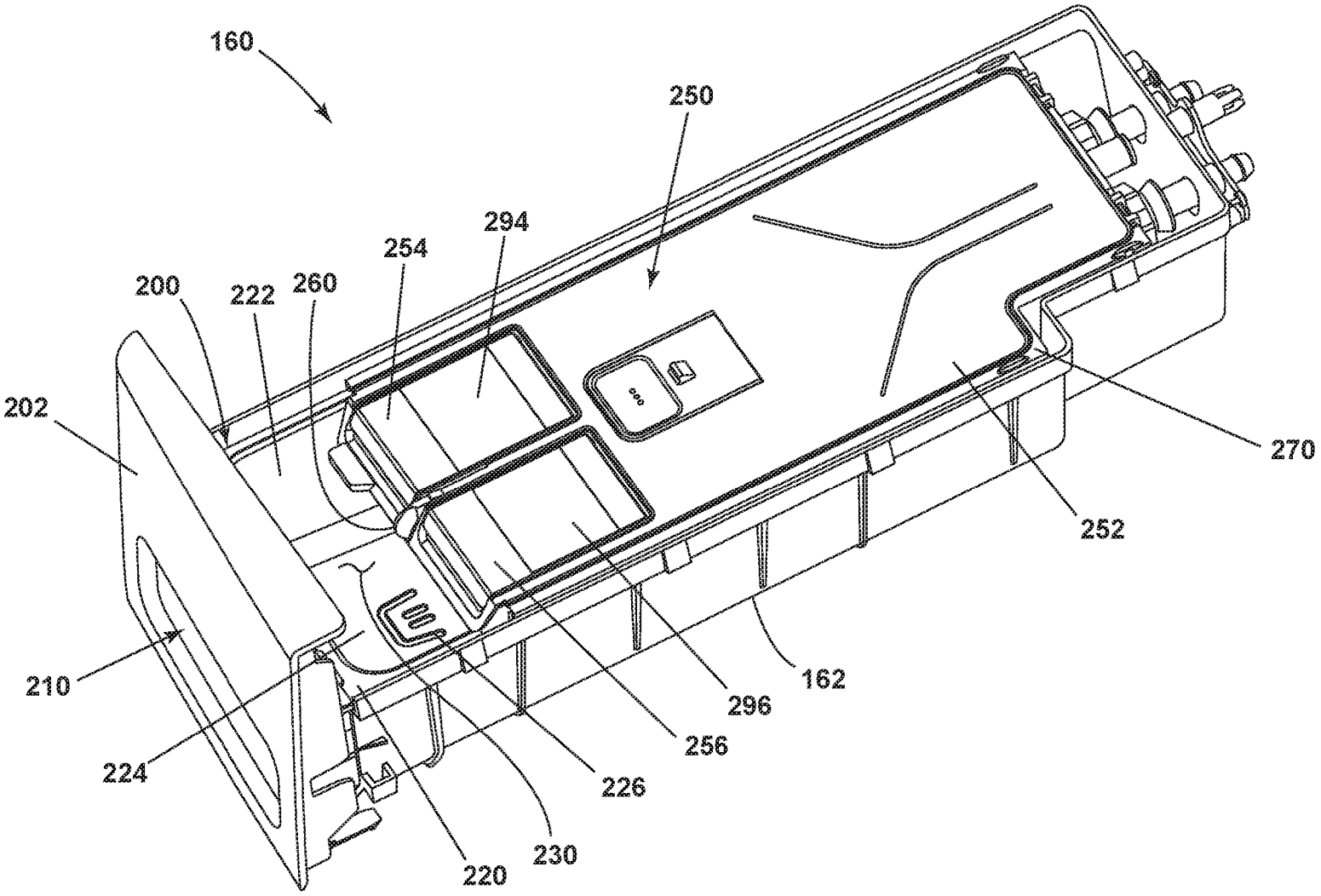
FIG. 3 is a top perspective view of a treating chemistry dispenser that can be included in the laundry treating appliance of FIG. 1, the treating chemistry dispenser having a cover removed to show a front drawer and a rear drawer, each in a closed position.
Figure 8:
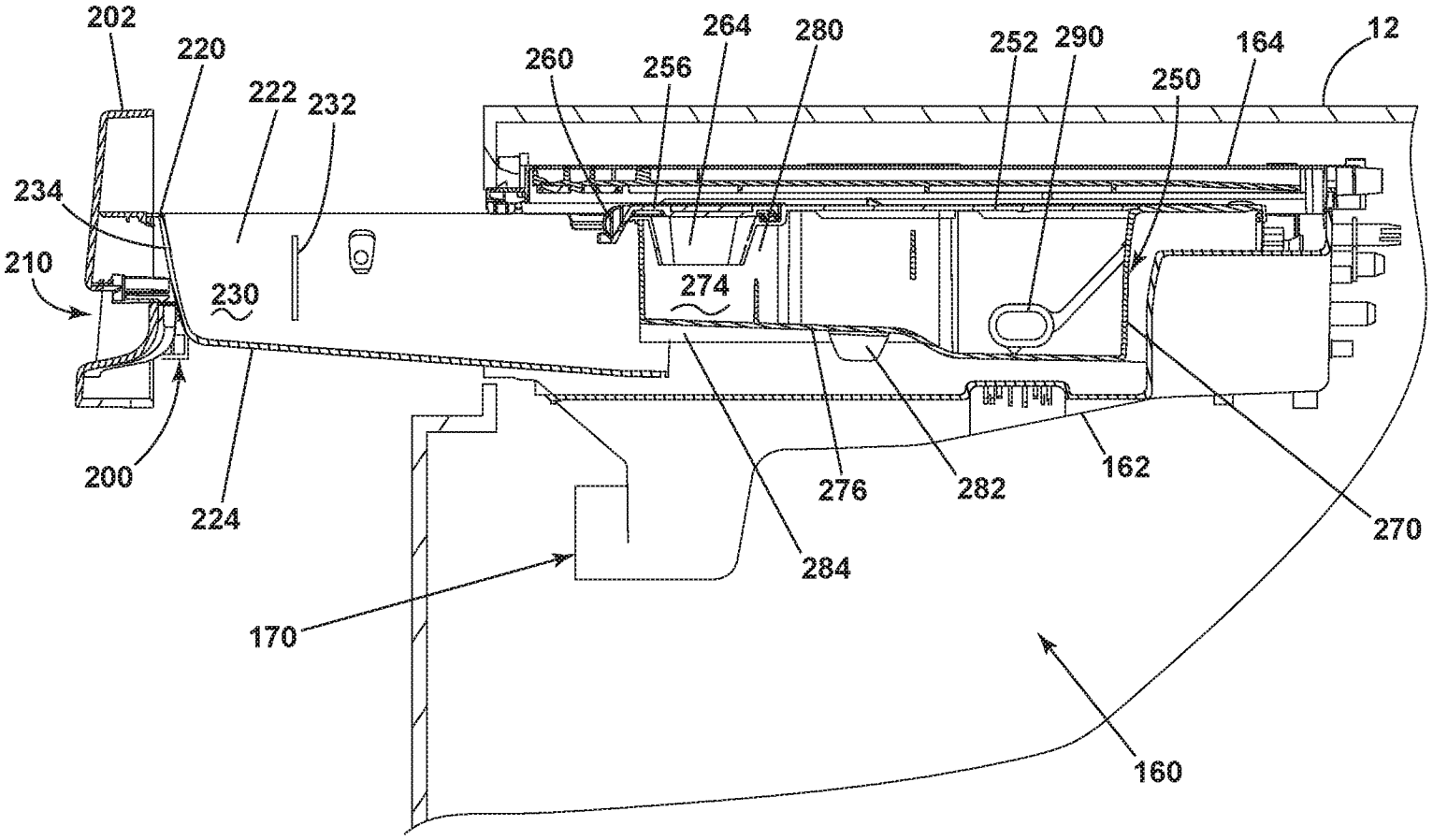
FIG. 8 is a cross-sectional view of the treating chemistry dispenser of FIG. 7 taken along line VIII-VIII of FIG. 7.

Referring now to FIG. 3, the treating chemistry dispenser 160 is at least partially defined by a dispenser lower housing 162 and a dispenser upper housing 164 (FIG. 5) that collectively at least partially define an interior. The dispenser upper housing 164 has been removed from FIG. 3 and FIG. 4 for a better view of the interior. The treating chemistry dispenser 160 comprises a first drawer 200, illustrated herein as a front drawer 200, and a second drawer 250, illustrated herein as a rear drawer 250 and located behind, or at least partially behind, the front drawer 200. Both the front drawer 200 and the rear drawer 250 are selectively received within the dispenser lower housing 162 and are independently slidable relative to both the cabinet 12 and to the dispenser lower housing 162 between a closed position, as shown, and an opened position (FIG. 8). When the front drawer 200 and the rear drawer 250 are in the closed positions, both the front drawer 200 and the rear drawer 250 are physically received within the dispenser lower housing 162 such that the dispenser lower housing 162 underlies both the front drawer 200 and the rear drawer 250 as shown.

Figure 7:
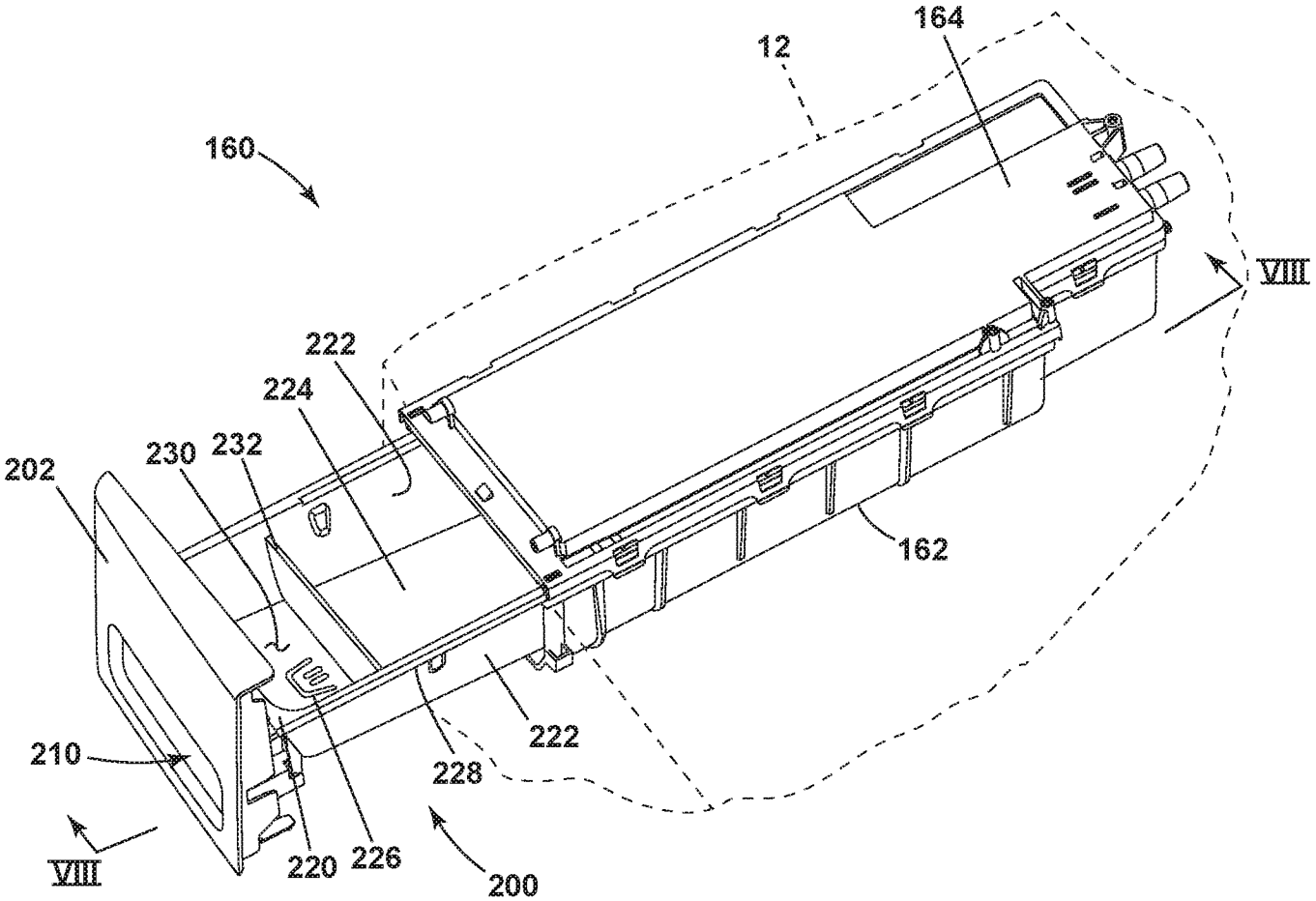
FIG. 7 is a top perspective view of the treating chemistry dispenser of FIG. 3, with the treating chemistry dispenser cover replaced, and with the front drawer in an opened position and the rear drawer in the closed position.

The front drawer 200 comprises a front drawer body 220 coupled to a drawer front 202. In one example, the drawer front 202 can be provided as part of a fascia or a decorative panel of the laundry treating appliance 10 and can form a portion of the cabinet 12. The drawer front 202 of the front drawer 200 can also serve as the front for the treating chemistry dispenser 160 as a whole. The drawer front 202 can include or define a handle 210 that can be configured, such as by being shaped, sized, or contoured, to be grasped by a user and by which a user can grip the drawer front 202 to move the front drawer 200 between the closed position as shown and the opened position (FIGS. 7-8). While the handle 210 is provided herein as a recessed handle 210 providing a grip for the user, the handle 210 can be any suitable type of handle 210, such as, by way of non-limiting example, a handle 210 incorporating a latching mechanism that can be actuated to allow the front drawer 200 to be withdrawn from the treating chemistry dispenser 160. While the drawer front 202 and the front drawer body 220 are illustrated herein as being fixedly coupled to one another, it is also contemplated that the drawer front 202 can be movably coupled to the front drawer body 220, such as that the drawer front 202 can pivot relative to the front drawer body 220.

Figure 5:
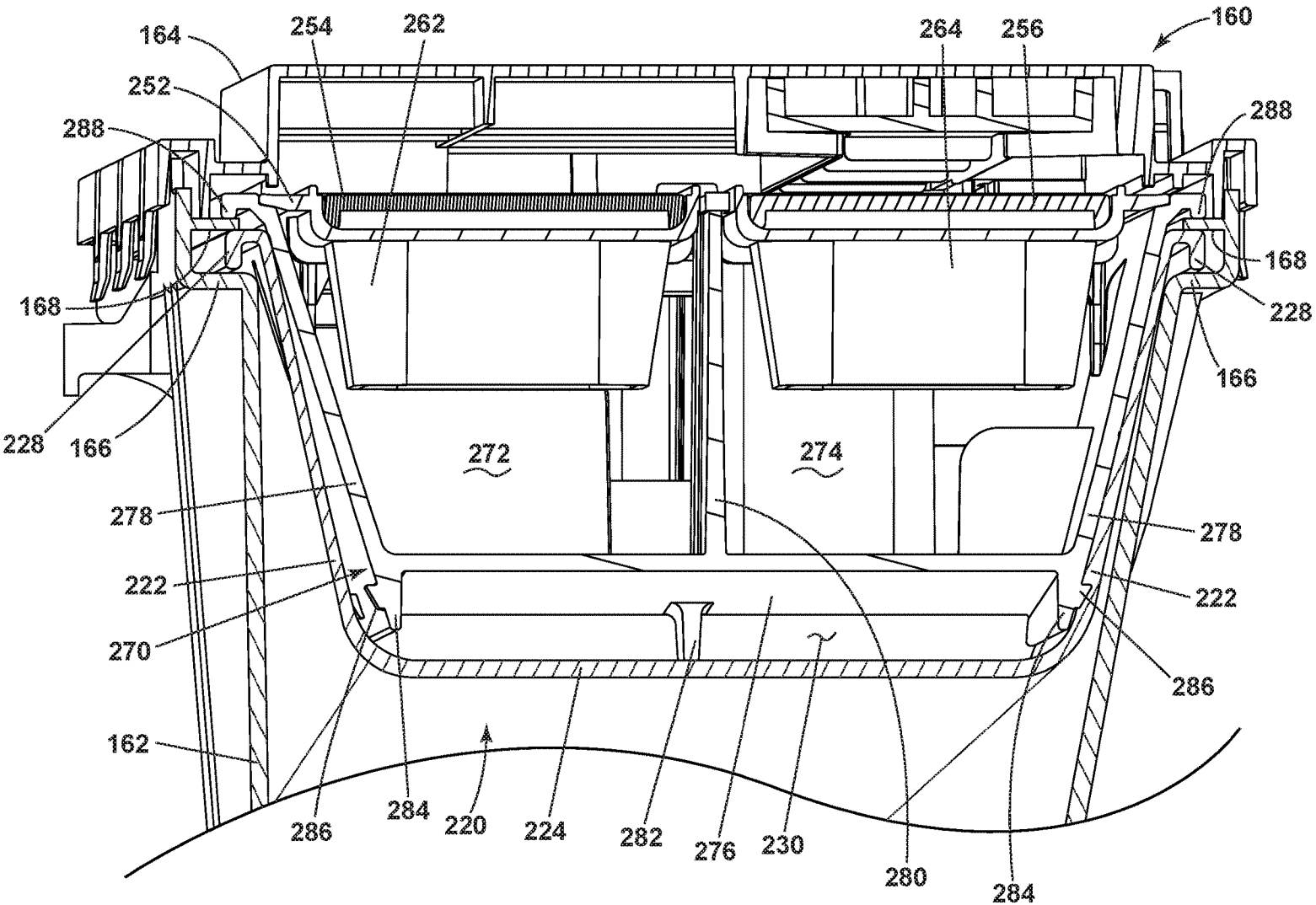
FIG. 5 is a cross-sectional view of the treating chemistry dispenser of FIG. 3, with the treating chemistry dispenser cover replaced, taken from the front of the treating chemistry dispenser.

The front drawer body 220 defines a width of the front drawer 200. In one example, the width of the front drawer body 220, and thus also the width of the front drawer 200, is coextensive in width with the dispenser lower housing 162. The front drawer body 220 includes at least a bottom wall 224 and a pair of opposing side walls 222 extending upwardly from the bottom wall 224, each side wall terminating in a peripheral edge 228 (FIG. 5). The front drawer body 220 can define at least one treating chemistry chamber 230, with the at least one treating chemistry chamber 230 located across the width of the front drawer 200, and more specifically across the width of the front drawer body 220. As illustrated herein, the at least one treating chemistry chamber 230 is provided as a single treating chemistry chamber 230 that extends across the width of the front drawer 200 and is at least partially defined by the bottom wall 224 and the opposing side walls 222. However, it will be understood that the at least one treating chemistry chamber 230 can include more than one treating chemistry chambers 230, such as, by way of non-limiting example, two treating chemistry chambers 230 located side-by-side across the width of the front drawer 200.

The at least one treating chemistry chamber 230 can include an indicia 226 that is visible to a user and can provide visual information or visual instruction to a user. By way of non-limiting example, the indicia 226 can indicate to the user a type of treating chemistry that can be provided to the at least one treating chemistry chamber 230, such as a liquid treating chemistry or a powder treating chemistry, or a detergent or a fabric softener, or a dose size that can be provided to the at least one treating chemistry chamber 230, such as a single dose or a bulk dose of treating chemistry. By way of non-limiting example, the indicia 226 can be provided on the bottom wall 224.

The at least one treating chemistry chamber 230 is provided herein as an open top container 230. In the case that more than one treating chemistry chamber 230 is provided within the front drawer 200, each of the treating chemistry chambers 230 can be provided as open top containers 230. In one example, the at least one treating chemistry chamber 230 of the front drawer 200 is configured to receive an amount of treating chemistry sufficient for a single cycle of operation of the laundry treating appliance 10. In this way, the front drawer 200 can be provided as a single dose dispenser drawer 200 with the at least one treating chemistry chamber 230 configured for single dose dispensing. In a further example, the at least one treating chemistry chamber 230 is configured to receive a powder treating chemistry, though it will be understood that the at least one treating chemistry chamber 230 is not limited to receiving a powder treating chemistry.

The rear drawer 250 comprises a rear drawer body 270 coupled with a drawer cover 252 that at least partially overlies the rear drawer body 270 and closes an open top of the rear drawer body 270. The drawer cover 252 can include at least one treating chemistry chamber cover 254, 256, illustrated herein as a first treating chemistry chamber cover 254 and a second treating chemistry chamber cover 256. The treating chemistry chamber covers 254, 256 can be movable relative to the drawer cover 252 between closed positions as shown and opened positions (not shown). The treating chemistry chamber covers 254, 256 can be any suitable type of closure that is movable relative to the drawer cover 252 to selectively allow the addition of treating chemistry to the rear drawer 250, non-limiting examples of which include snap-fit covers, screw-on covers, plug type covers, or rotatable or pivotable covers, such as flip covers. By further way of non-limiting example, the treating chemistry chamber covers 254, 256 can be pivotably coupled with the drawer cover 252, such as hingedly mounted to the drawer cover 252, to selectively allow access to an interior of the rear drawer 250.

Figure 9:
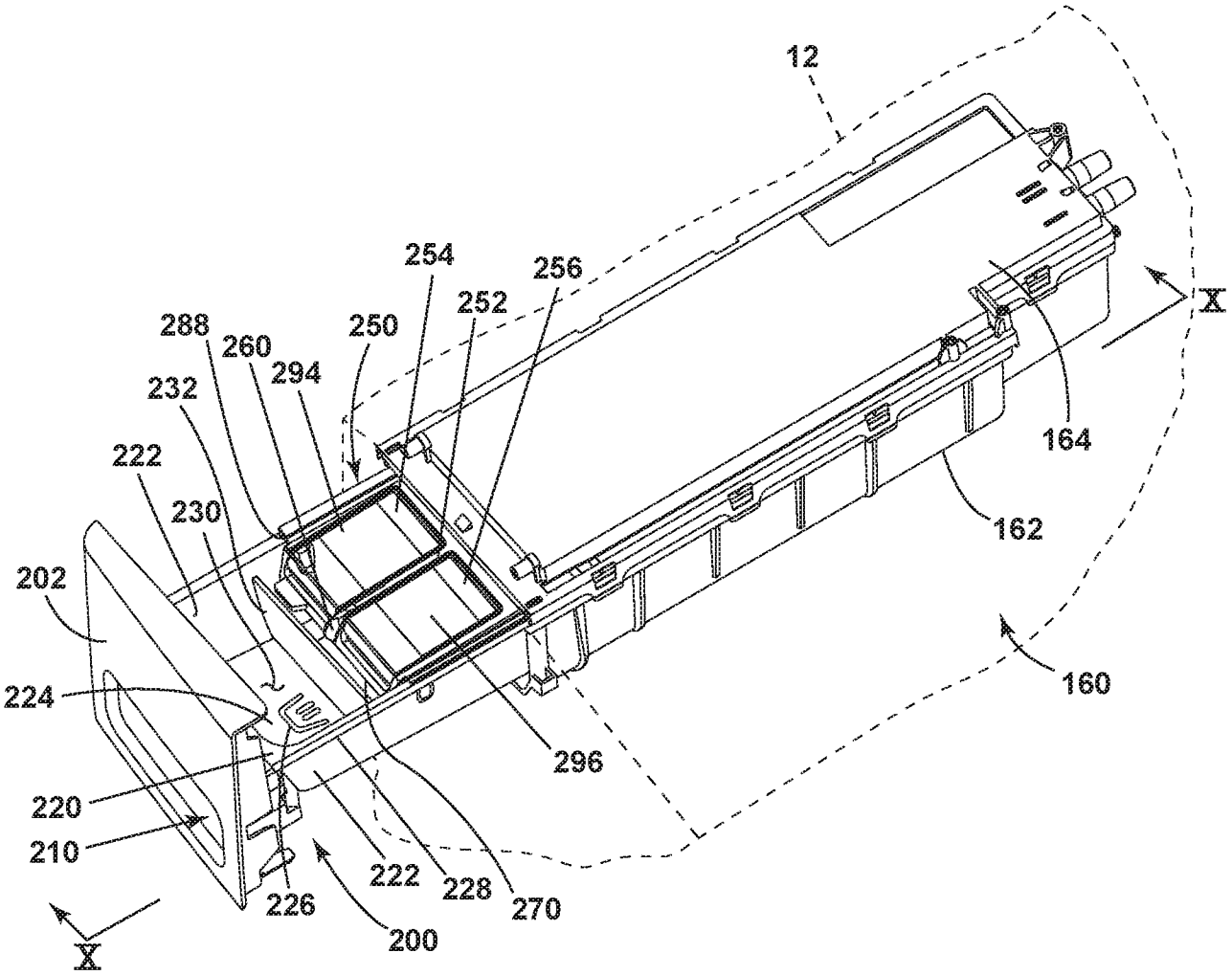
FIG. 9 is a top perspective view of the treating chemistry dispenser of FIG. 7 with both the front drawer and the rear drawer in an opened position.
Figure 10:
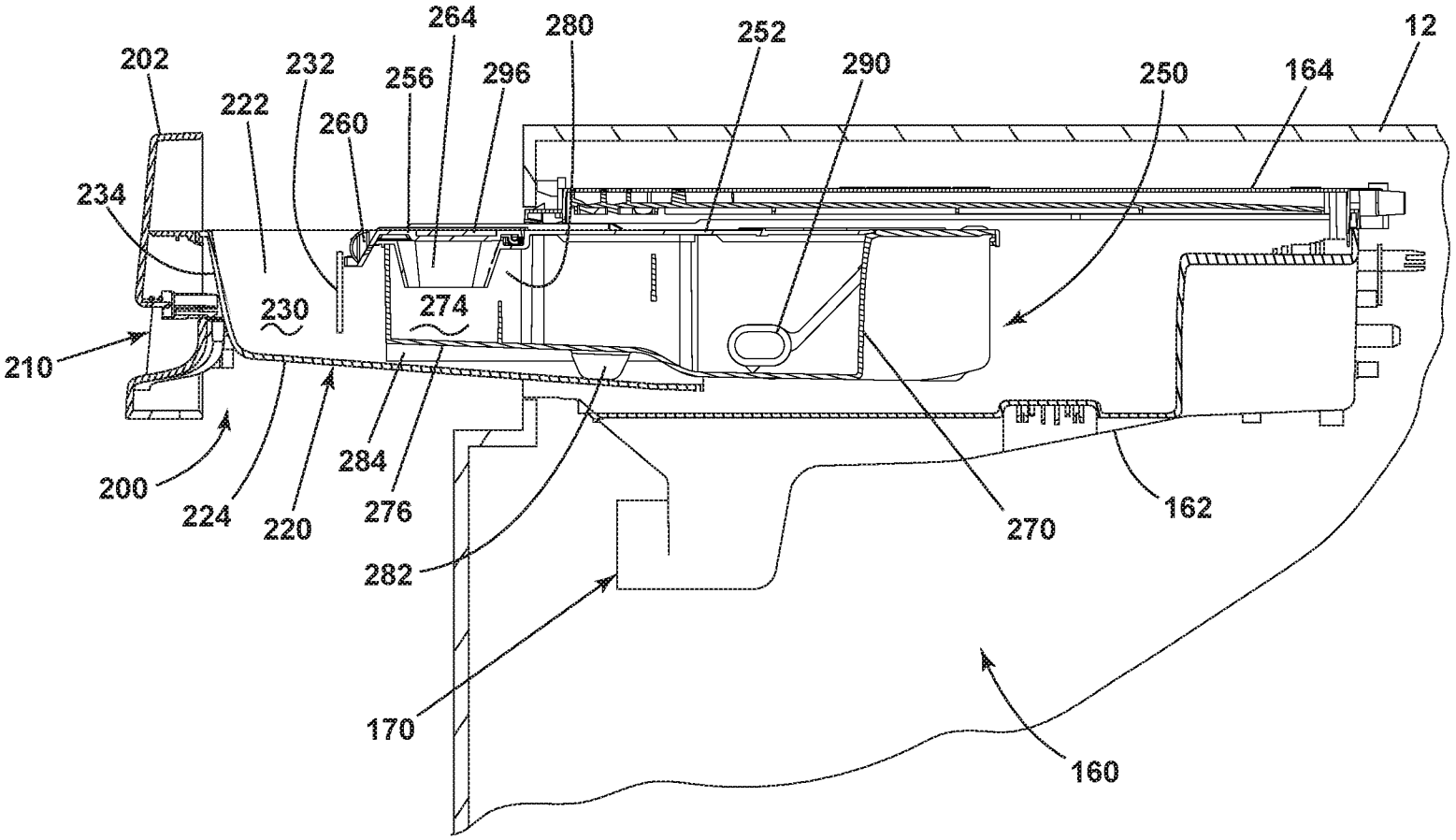
FIG. 10 is a cross-sectional view of the treating chemistry dispenser of FIG. 9 taken along line X-X of FIG. 9.

The rear drawer 250 further comprises a handle, illustrated by way of non-limiting example as a tab 260, that can be configured, such as by being shaped, sized, or contoured, to be grasped or gripped by a user and by which the user can grip the rear drawer 250 to move the rear drawer 250 between the closed position as shown and the opened position (FIGS. 9-10). The rear drawer 250 can include any suitable type of handle for moving the rear drawer 250 between the closed and opened positions, and can also optionally include any suitable type of latching mechanism for latching the rear drawer 250 in the closed position.

The rear drawer body 270 defines a width of the rear drawer 250. In one example, the width of the rear drawer body 270, and thus also the width of the rear drawer 250, is coextensive in width with the dispenser lower housing 162. Alternatively, or additionally, the width of the rear drawer 250 can be coextensive with the width of the front drawer 200.

Figure 4:
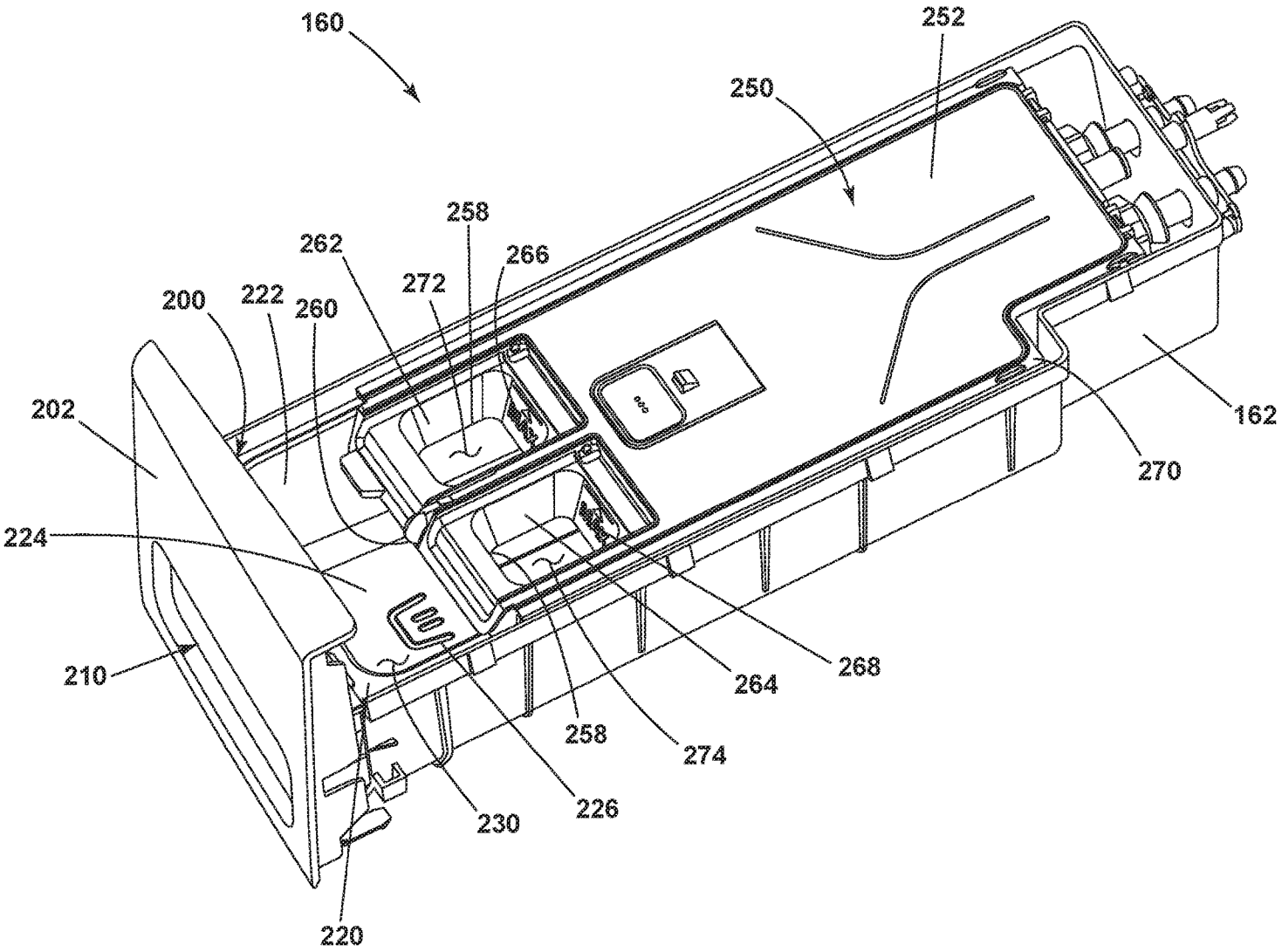
FIG. 4 is a top perspective view of the treating chemistry dispenser of FIG. 3 with treating chemistry chamber covers removed from the rear drawer.

Referring now to FIG. 4, in which the treating chemistry chamber covers 254, 256 are removed from the rear drawer 250 for a better view of the interior, the rear drawer body 270 includes one or more treating chemistry chambers 272, 274, illustrated herein as a first treating chemistry chamber 272 and a second treating chemistry chamber 274. The first and second treating chemistry chambers 272, 274 are located across the width of the rear drawer 250, and more specifically across the width of the rear drawer body 270. As illustrated herein, the first and second treating chemistry chambers 272, 274 are provided side-by-side to extend across the width of the rear drawer 250. However, it will be understood that the one or more treating chemistry chambers 272, 274 can be provided as only a single treating chemistry chamber 272 extending across the width of the rear drawer 250, or that more than two treating chemistry chambers 272, 274 can be provided side-by-side to extend across the width of the rear drawer 250. Regardless of the number or the configuration of the treating chemistry chambers 272, 274 included with the rear drawer 250, the treating chemistry chambers 272, 274 of the rear drawer 250 are located behind the at least one treating chemistry chamber 230 of the front drawer 200, relative to the front 202 of the treating chemistry dispenser 160.

The rear drawer 250 further includes a first bezel 262 provided with the first treating chemistry chamber 272 and a second bezel 264 provided with the second treating chemistry chamber 274. The first and second bezels 262, 264 can be carried by the drawer cover 252, such as by being coupled with, defined by, or formed within the drawer cover 252. The first and second bezels 262, 264 at least partially overlie the first and second treating chemistry chambers 272, 274, respectively, to each at least partially define a fill opening 258 of the first and second treating chemistry chambers 272, 274, respectively, through which treating chemistry can be provided into the treating chemistry chambers 272, 274. The first and second bezels 262, 264 can function as baffles to prevent liquid from splashing from the treating chemistry chambers 272, 274, respectively, during operation or movement of the treating chemistry dispenser 160 or when filling the treating chemistry chambers 272, 274 with a treating chemistry, such as a liquid treating chemistry.

The treating chemistry chambers 272, 274 can each include an indicia 266, 268, illustrated herein as a first indicia 266 provided with the first treating chemistry chamber 272 and a second indicia 268 provided with the second treating chemistry chamber 274, the indicia 266, 268 visible to the user to provide visual information or visual instruction to the user. By way of non-limiting example, the indicia 266, 268 can indicate to the user a type of treating chemistry that can be provided to the treating chemistry chambers 272, 274, respectively, such as a liquid treating chemistry or a powder treating chemistry, a detergent or a fabric softener, a dose size that can be provided to the treating chemistry chambers 272, 274, respectively, such as a single dose or a bulk dose of treating chemistry, or a fill level indicator. Such a fill level indicia 266, 268 can include a viewing window, which can be provided as at least a portion of the bezel 262, 264 or the treating chemistry chambers 272, 274 that is transparent and provides a view of at least a portion of the interior of the treating chemistry reservoirs 272, 274 so that the user can view a fill level of the treating chemistry within the treating chemistry reservoirs 272, 274. In one example, the first indicia 266 can be provided on the first bezel 262 and the second indicia 268 can be provided on the second bezel 264.

The treating chemistry chamber covers 254, 256 are coupled to the first and second treating chemistry chambers 272, 274, respectively, to selectively allow access to the treating chemistry chambers 272, 274, as well as to selectively open or close the fill openings 258 as the treating chemistry chamber covers 254, 256 move between the closed and opened positions. Specifically, the first treating chemistry chamber cover 254 at least partially overlies both the first treating chemistry chamber 272 and the first bezel 262 to selectively open and close the first treating chemistry chamber 272 and the corresponding fill opening 258, while the second treating chemistry chamber cover 256 at least partially overlies both the second treating chemistry chamber 274 and the second bezel 264 to selectively open and close the second treating chemistry chamber 274 and the corresponding fill opening 258.

The treating chemistry chamber covers 254, 256 can optionally include an indicia 294, 296 (FIG. 3) visible to the user to provide visual information or visual instruction to the user. By way of non-limiting example, the indicia 294, 296 can indicate to the user a type of treating chemistry that can be provided to the treating chemistry chambers 272, 274, respectively, such as a liquid treating chemistry or a powder treating chemistry, a detergent or a fabric softener, or a dose size that can be provided to the treating chemistry chambers 272, 274, respectively, such as a single dose or a bulk dose of treating chemistry. In one example, the indicia 294, 296 can be provided on the treating chemistry chamber covers 254, 256 such that the indicia 294, 296 are visible to the user when the treating chemistry chamber covers 254, 256 are in the closed positions.

As illustrated herein, at least one of the first and second treating chemistry chambers 272, 274 can be provided as a bulk treating chemistry reservoir 272, 274. In one example, each of the first and second treating chemistry chambers 272, 274 are provided as a bulk treating chemistry reservoir 272, 274. In the case that more than two treating chemistry chambers 272, 274 are included within the rear drawer 250, each of the treating chemistry chambers 272, 274 can be provided as a bulk treating chemistry reservoir 272, 274. Each of the first and second treating chemistry chambers 272, 274 of the rear drawer 250 are configured to receive an amount of treating chemistry that is sufficient for multiple cycles of operation of the laundry treating appliance 10. In this way, the rear drawer 250 can be provided as a bulk dispenser drawer 250 with each of the first and second treating chemistry chambers 272, 274 configured for bulk dispensing. In a further example, each the first and second treating chemistry chambers 272, 274 are configured to receive a liquid treating chemistry, though it will be understood that the first and second treating chemistry chambers 272, 274 are not limited to receiving a liquid treating chemistry. By way of non-limiting example, the first treating chemistry chamber 272 can be configured for bulk dispensing of a liquid detergent, while the second treating chemistry chamber 274 can be configured for bulk dispensing of a liquid fabric softener.

Referring now to FIG. 5, the rear drawer body 270 includes at least a bottom wall 276 and a pair of opposing side walls 278 extending upwardly from the bottom wall 276, each side wall 278 terminating in a peripheral edge 288. A partition 280, illustrated herein as a center wall 280, is provided between the side walls 278 and also extends upwardly from the bottom wall 276. In one example, the center wall 280 is provided equidistant between the opposing side walls 278 and extends from the front to the rear of the rear drawer 250 substantially parallel to the side walls 278. The first treating chemistry chamber 272 is at least partially defined by the bottom wall 276, one of the side walls 278, and the center wall 280, while the second treating chemistry chamber 274 is at least partially defined by the bottom wall 276, the other of the side walls 278, and the center wall 280. In the case that only a single treating chemistry chamber 272 is included, the center wall 280 may not be included. However, in the case that more than two treating chemistry chambers 272, 274 are included, more than one center wall 280 can be provided.

At least when the front drawer 200 and the rear drawer 250 are both in the closed position or are both in the opened position, the rear drawer 250 can at least partially overlie, yet be vertically spaced from, the front drawer 200, and specifically the bottom wall 224 of the front drawer 200 can at least partially underlie, yet be vertically spaced from, the rear drawer 250. The rear drawer body 270 further includes a variety of features to maintain appropriate spacing and stability between the front drawer 200 and the rear drawer 250. In one example, a central spacing rib 282 can extend downwardly from the bottom wall 276 of the rear drawer 250 to maintain the spacing between the bottom wall 276 and the bottom wall 224 even in the case that the central spacing rib 282 contacts the bottom wall 224 of the front drawer 200. The central spacing rib 282 can abut the bottom wall 224 or can be spaced above the bottom wall 224. While only a single central spacing rib 282 is illustrated, any suitable number of spacing ribs 282 can be included and can be positioned at any suitable point of the bottom wall 276.

Further, a pair of opposing spacing feet 284 can extend downwardly from the respective side walls 278, protruding below the bottom wall 276 to maintain the spaced relationship between the bottom wall 276 and the bottom wall 224 even in the case that the spacing feet 284 contact the bottom wall 224 of the front drawer 200. Each of the spacing feet 284 can further include at least one lateral spacing rib 286 extending laterally outwardly from the spacing foot 284, protruding from the spacing foot 284 in a direction away from the center wall 280. The lateral spacing ribs 286 can bear against the side walls 222 to center the rear drawer body 270 within the front drawer body 220. The spacing feet 284 and the at least one lateral spacing ribs 286 can abut or can be spaced from the bottom wall 224 or the side walls 222, respectively. While a pair of spacing feet 284 is illustrated, any suitable number of spacing feet 284 can be provided, including only a single spacing foot 284 extending from only one of the side walls 278. Alternatively, rather than extending downwardly from the side walls 278, the spacing feet 284 can extend downwardly from the bottom wall 276 at a position not aligned with the side walls 278. While multiple lateral spacing ribs 286 are illustrated as extending from each spacing foot 284, any suitable number of lateral spacing ribs 286 can be included and can be positioned at any suitable point along the spacing feet 284. Alternatively, the lateral spacing ribs 286 can extend from the side walls 278 rather than from the spacing feet 284.

The dispenser upper housing 164 overlies and is coupled with the dispenser lower housing 162. The dispenser upper housing 164 and the dispenser lower housing 162 which can be thought of together as forming a dispenser housing. The dispenser lower housing 162 includes at least a first guide rib 166 that defines a slide path for the front drawer 200 and at least a second guide rib 168 that defines a slide path for the rear drawer 250. In one example, the dispenser lower housing 162 includes a pair of first guide ribs 166 and a pair of second guide ribs 168, the two guide ribs 166 or 168 of each pair located at opposing sides of the dispenser lower housing 162. Both the pairs of the first and second guide ribs 166, 168 extend at least partially along a length from the front to the rear of the dispenser lower housing 162. In one example, the pair of the second guide ribs 168 overlies the pair of the first guide ribs 166 and extends at least partially along the length of the pair of the first guide ribs 166. By way of non-limiting example, the first guide ribs 166 and the second guide ribs 168 can be parallel with one another and/or can be coextensive in length with one another from the front to the rear of the dispenser lower housing 162. The slide paths of the front drawer 200 and the rear drawer 250, as defined by the first guide ribs 166 and the second guide ribs 168, respectively, can be at least partially coextensive and coplanar with one another.

The peripheral edges 228 of the front drawer 200 can rest on the first guide ribs 166 such that the front drawer 200 is movable between the closed position and the opened position by sliding along the slide path defined by the first guide ribs 166 to be at least partially removed from or inserted into the dispenser lower housing 162. The peripheral edges 288 of the rear drawer 250 can rest on the second guide ribs 168 such that the rear drawer 250 is movable between the closed position and the opened position by sliding along the slide path defined by the second guide ribs 168 to be at least partially removed from or inserted into the dispenser lower housing 162.

Figure 6:
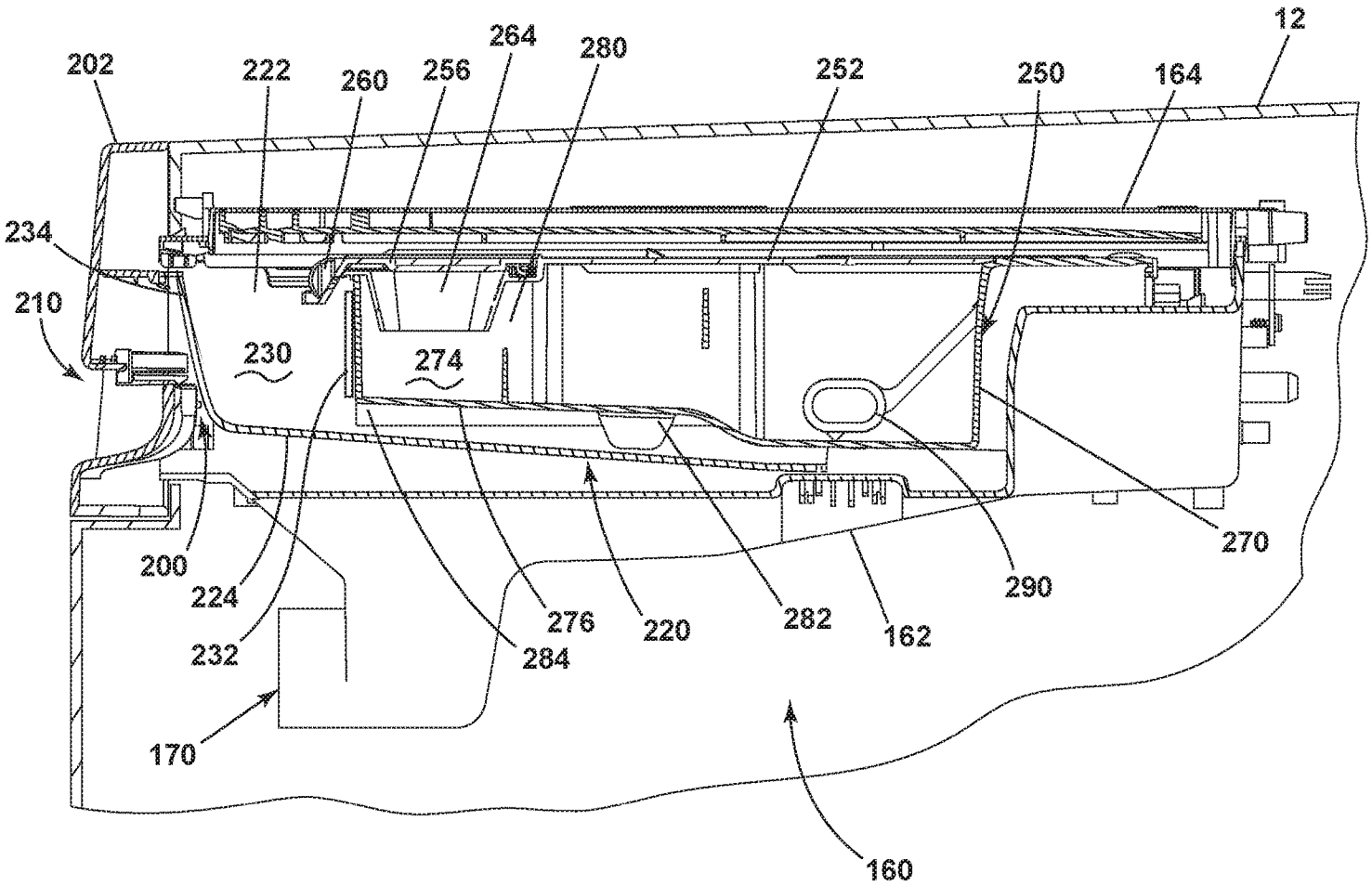
FIG. 6 is a cross-sectional view of the treating chemistry dispenser of FIG. 3, with the treating chemistry dispenser cover replaced, and taken from the side of the treating chemistry dispenser with both the front drawer and the rear drawer in the closed position.

Referring now to FIG. 6, the front drawer body 220 further comprises a front wall 234 extending upwardly from the bottom wall 224 and at least partially abutting the drawer front 202. In one example, the bottom wall 224 slopes downwardly from the front wall 234 as it extends rearwardly away from the front wall 234. As shown, when the front drawer 200 and the rear drawer 250 are both in the closed positions, both the front drawer 200 and the rear drawer 250 are physically received within the dispenser lower housing 162 and the dispenser upper housing 164, such that the dispenser lower housing 162 underlies both the front drawer 200 and the rear drawer 250, and further such that the dispenser upper housing 164 overlies both the front drawer 200 and the rear drawer 250. The cabinet 12 additionally receives and overlies both the front drawer 200 and the rear drawer 250 in the closed positions. Further, the front drawer body 220 at least partially receives the rear drawer 250, specifically such that the bottom wall 224 at least partially underlies the rear drawer 250. In addition, the bottom wall 224 overlying the dispenser lower housing 162 further fluidly couples the front drawer body 220, as well as the treating chemistry chamber 230, with a dispenser outlet 170 defined by the dispenser lower housing 162. The dispenser outlet 170 is further fluidly coupled with the treating chamber 18 via the dispensing outlet conduit 64.

The front drawer body 220 further comprises a partition 232 that extends between and is coupled to the side walls 222. The partition 232 can be spaced rearwardly from the front wall 234 and can further at least partially define the at least one treating chemistry chamber 230. The partition 232 is positioned such that it limits or acts as a boundary for relative movement between the front drawer 200 and the rear drawer 250, thus maintaining the appropriate spacing between the front drawer 200 and the rear drawer 250. In addition to maintaining the spacing between the front drawer 200 and the rear drawer 250, when the rear drawer 250 and the front drawer 200 are both in the closed position as shown, the front drawer 200, including the drawer front 202 and the partition 232, physically block or prevent access to the rear drawer 250. In this way, the rear drawer 250 is prevented from being moved from the closed position to the opened position when the front drawer 200 is in the closed position.

Turning now to FIG. 7, the rear drawer 250 is in the closed position and received within the dispenser housing 162, 164, while the front drawer 200 is shown in the opened position relative to the dispenser housing 162, 164 and to the cabinet 12. While the rear drawer 250 is not shown as visible in this view, it will be understood that it may be desirable for at least a portion of the rear drawer 250, by way of non-limiting example the tab 260, to be visible to the user for easy location and access at any point in time, including when the rear drawer 250 is in the closed position. In such an example, the portion of the rear drawer 250, such as the tab 260, can be positioned and sized that that it is visible to the user, and outside or exterior of the dispenser housing 162, 164, in both the closed and the opened positions. The opened position of the front drawer 200 can also comprise a fill position for the front drawer 200, and specifically for the at least one treating chemistry chamber 230, such that the user is allowed access to the at least one treating chemistry chamber 230 for the addition of treating chemistry when the front drawer 200 is in the opened position. Conversely, the closed position of the front drawer 200, as shown in FIG. 6, can be thought of as a dispense position for the front drawer 200, when user access to the at least one treating chemistry chamber 230 for filling or addition of treating chemistry is prevented, but dispensing of the treating chemistry from the front drawer 200 can instead occur.

As shown in FIG. 8, when the front drawer 200 is in the opened position and the rear drawer 250 is in the closed position, the rear drawer 250 remains physically received within the dispenser lower housing 162 and the dispenser upper housing 164, such that the dispenser lower housing 162 underlies the rear drawer 250 and the dispenser upper housing 164 overlies the rear drawer 250. The cabinet 12 additionally receives and overlies the rear drawer 250 in the closed position. With the front drawer 200 in the opened position, the front drawer 200 is at least partially removed from the dispenser lower and upper housings 162, 164, such that at least a portion of the front drawer 200 does not overlie the dispenser lower housing 162 and does not underlie the dispenser upper housing 164. Further, the front drawer 200 is at least partially withdrawn from the cabinet 12, such that at least a portion of the front drawer 200 does not underlie the cabinet 12 and is not received by the cabinet 12. In one example and as illustrated, the front drawer 200 in the opened position maintains a portion of the bottom wall 224 overlying the dispenser lower housing 162 to remain fluidly coupled with the dispenser outlet 170.

Further still, with the front drawer 200 in the opened position and the rear drawer 250 in the closed position, the front drawer body 220 does not receive the rear drawer 250 to as great an extent as when the front drawer 200 is in the closed position, specifically such that the bottom wall 224 does not underlie the rear drawer 250 to as great an extent as when the front drawer 200 is in the closed position (FIG. 6). In one example, when the front drawer 200 is in the opened position, the front drawer body 220 does not receive any portion of the rear drawer 250 and the bottom wall 224 does not underlie any portion of the rear drawer 250.

Turning now to FIG. 9, the front drawer 200 is in the opened position and the rear drawer 250 is shown in the opened position relative to the dispenser housing 162, 164 and to the cabinet 12. The opened position of the rear drawer 250 can also comprise a fill position for the rear drawer 250, and specifically for the first and second treating chemistry chambers 272, 274, such that the user is allowed access to the first and second treating chemistry chambers 272, 274 for the addition of treating chemistry when the rear drawer 250 is in the opened position. Conversely, the closed position of the rear drawer 250 can be thought of as a dispense position for the rear drawer 250, when user access to the first and second treating chemistry chambers 272, 274 for filling or addition of treating chemistry is prevented, but dispensing of the treating chemistries from the rear drawer 250 can instead occur.

As shown in FIG. 10, when the front drawer 200 and the rear drawer 250 are both in the opened positions, both the front drawer 200 and the rear drawer 250 are at least partially removed from the dispenser lower and upper housings 162, 164, such that at least a portion of the front drawer 200 and at least a portion of the rear drawer 250 does not overlie the dispenser lower housing 162 and does not underlie the dispenser upper housing 164. Further, the front drawer 200 and the rear drawer 250 are at least partially withdrawn from the cabinet 12, such that at least a portion of the front drawer 200 and at least a portion of the rear drawer 250 do not underlie the cabinet 12 and are not received by the cabinet 12.

Further still, with the front drawer 200 and the rear drawer 250 both in the opened positions, the front drawer body 220 again at least partially receives the rear drawer 250, specifically such that the bottom wall 224 at least partially underlies the rear drawer 250. In one example, the relative spacing of the front drawer 200 and the rear drawer 250 when both are in the opened positions can be the same as when both are in the closed positions. However, it will also be understood that with both the front and rear drawers 200, 250 in the opened positions, the rear drawer 250 may not be received by the front drawer body 220 and may not overlie the bottom wall 224 to the same extent as when both the front and rear drawers 200, 250 are in the closed positions.

Turning now to the operation of the treating chemistry dispenser 160, to move the front drawer 200 from the closed position of FIG. 6 to the opened position of FIGS. 7-8, in one example, the user can pull on the handle 210 to slidably withdraw the front drawer 200 from the treating chemistry dispenser 160. Specifically, as the user pulls on the handle 210, the front drawer 200 is withdrawn from the dispenser housing 162, 164 along the slide path defined by the first guide ribs 166 to move from the closed position to the opened position. In the opened position, the front drawer 200 is accessible and presented to a user such that the user can add treating chemistry to the treating chemistry chamber 230. Further, with the front drawer 200 in the opened position, the rear drawer 250 is also accessible by the user.

In one example, the front drawer 200 can be withdrawn from the treating chemistry dispenser 160 even beyond the opened position of FIGS. 7-8, such that the front drawer 200 is completely removable from the treating chemistry dispenser 160 and from the laundry treating appliance 10. In a further and optional example, the laundry treating appliance 10 can be configured to operate a cycle of operation even when the front drawer 200 is completely removed. When the front drawer 200 is either in the opened position or entirely removed from the treating chemistry dispenser 160, user access to the rear drawer 250 is no longer blocked, and the user is permitted to selectively withdraw the rear drawer 250 from the dispenser housing 162, 164.

To move the rear drawer 250 from the closed position of FIGS. 6-8 to the opened position of FIGS. 9-10, in one example, the user can pull on the tab 260 to slidably withdraw the rear drawer 250 from the treating chemistry dispenser 160. Specifically, as the user pulls on the tab 260, the rear drawer 250 is withdrawn from the dispenser housing 162, 164, along the slide path defined by the second guide ribs 168 to move the rear drawer 250 from the closed position to the opened position. In another example, the user can push on the tab 260, such as to actuate a push-push mechanism, to allow the rear drawer 250 to then be slidably withdrawn from the treating chemistry dispenser 160 from the closed position into the opened position. When the front drawer 200 is in the opened position and the rear drawer 250 is moved from the closed position toward the opened position, further forward movement or withdrawal of the rear drawer 250 from the dispenser lower housing 162 is prevented when the rear drawer 250 comes into contact with or abuts the partition 232, defining the opened position. In the opened position, the rear drawer 250 is accessible and presented to a user such that the user can add treating chemistry to the treating chemistry chambers 272, 274.

In one example, the rear drawer 250 can be withdrawn from the treating chemistry dispenser 160 even beyond the opened position, such that the rear drawer 250 is completely removable from the treating chemistry dispenser 160 and from the laundry treating appliance 10. Due to the dimensions of the rear drawer 250, it may only be possible to completely remove the rear drawer 250 when the front drawer 200 has already been completely removed. After the rear drawer 250 has been completely removed, the user can choose to re-insert the front drawer 200 back into the treating chemistry dispenser 160, even with the rear drawer 250 still removed. In this way, the laundry treating appliance 10 can be configured to operate a cycle of operation even when the rear drawer 250 is completely removed.

When the user has completed the addition of treating chemistry to either of or to both of the front drawer 200 and the rear drawer 250, the front drawer 200 and the rear drawer 250 can be returned to the closed positions in preparation for a cycle of operation. First, the user can push against the tab 260 to move, such as by slidably inserting, the rear drawer 250 into the treating chemistry dispenser 160. Specifically, as the user pushes against the tab 260, the rear drawer 250 is slid into the dispenser housing 162, 164 along the slide path defined by the second guide ribs 168 to move the rear drawer 250 from the opened position to the closed position. Once the rear drawer 250 has been returned to the closed position, the user can then push on the handle 210 to move, such as by slidably inserting, the front drawer 200 into the treating chemistry dispenser 160. Specifically, as the user pushes against the handle 210, the front drawer 200 is slid into the dispenser housing 162, 164 along the slide path defined by the first guide ribs 166 to move the front drawer 200 from the opened position to the closed position. When the rear drawer 250 is in the closed position and the front drawer 200 is moved from the opened position toward the closed position, further rearward movement or insertion of the front drawer 200 into the dispenser lower housing 162 is prevented when the partition 232 comes into contact with or abuts the rear drawer 250, defining the closed position.

With both the front drawer 200 and the rear drawer 250 in the closed positions, the bottom wall 224 of the front drawer 200 again at least partially underlies the rear drawer 250 to facilitate the operation of the treating chemistry dispenser 160. In one example, the downward slope of the bottom wall 224 facilitates the flow of treating chemistry and liquid from the treating chemistry chamber 230 rearwardly along the bottom wall 224. The treating chemistry and liquid can flow off of the bottom wall 224 and out of the front drawer 200 to collect within the dispenser lower housing 162. Liquid and treating chemistry collected within the dispenser lower housing 162 is provided to the dispenser outlet 170 that is fluidly coupled with the treating chamber 18 via the dispensing outlet conduit 64. Liquid and treating chemistry contained within the first and second treating chemistry chambers 272, 274 can be removed from the treating chemistry chambers 272, 274 and provided to the treating chamber 18 via at least one pump 290. In one example, each of the treating chemistry chambers 272, 274 include a pump 290 provided within and fluidly coupled to each of the first and second treating chemistry chambers 272, 274 for dispensing of the treating chemistry.

The front drawer 200 and the rear drawer 250 are slidably moveable along the respective slide paths between closed and opened positions independently of one another. For example, when the rear drawer 250 is in the closed position, the front drawer 200 can be freely moved between the closed and opened positions. When the front drawer 200 is in the opened position, the rear drawer 250 can be freely moved between the closed and the opened positions. However, not all relative movements between the front drawer 200 and the rear drawer 250 are possible. In one example, the rear drawer 250 is only movable to the opened position when the front drawer 200 is either in the opened position or is entirely removed from the treating chemistry dispenser 160, as access to the rear drawer 250 is prevented when the front drawer 200 is in the closed position. Likewise, when the rear drawer 250 is in the opened position, the front drawer 200 is not movable to the closed position without first moving the rear drawer 250 to the closed position.

The aspects of the present disclosure described herein set forth a treating chemistry dispenser that allows a great deal of flexibility to the user by providing a single treating chemistry dispenser having both a single dose dispensing drawer and a bulk dispensing drawer. Such an integrated single-dose and bulk-dispensing treating chemistry dispenser provides the user with a variety of options for cycles of operation and for filling and storing treating chemistries, without adding a great deal of complication, such as by having separate, spaced apart locations for filling single dose treating chemistries or bulk dispensed treating chemistries. In addition, integrating the single dose and bulk dispensing systems within the single dispenser saves space within the laundry treating appliance while still having the additional functionality of being able to choose between single dose and bulk dispensing. By allowing the laundry treating appliance to be operable with either one of the single dose dispensing drawer or the bulk dispensing drawer removed from the treating chemistry dispenser, even more flexibility can be offered to the user. Further still, the treating chemistry dispenser also allows for dispensing of powder or liquid treating chemistries.

It will also be understood that various changes and/or modifications can be made without departing from the spirit of the present disclosure. By way of non-limiting example, although the present disclosure is described for use with a treating chemistry dispenser having a front drawer configured for single dose dispensing and a rear drawer configured for bulk dispensing, it will be recognized that the treating chemistry dispenser can be employed with various constructions, including that the front drawer can be configured for bulk dispensing while the rear drawer is configured for single dose dispensing, that both the front and rear drawers can be configured for bulk dispensing, or that both the front and rear drawers can be configured for single dose dispensing.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A laundry treating appliance for treating laundry according to an automatic cycle of operation, the laundry treating appliance comprising: a cabinet defining an interior; a treating chamber located within the interior; and a dispenser fluidly coupled to the treating chamber and comprising: a front drawer slidable along a slide path relative to the cabinet between opened and dosed positions and having one or more treating chemistry chambers located across a width of the front drawer; and a rear drawer, located behind the front drawer, and slidable along the slide path between opened and dosed positions and having one or more treating chemistry chambers located across a width of the rear drawer and located behind the treating chemistry chambers of the front drawer at east when the front drawer is in the closed position; wherein the front and rear drawers are independently slidable along the slide path and the front drawer blocks access to the rear drawer when the front drawer is in the closed position; wherein the width of the rear drawer is substantially equal to the width of the front drawer.

2. The laundry treating appliance of claim 1 wherein the dispenser further comprises a dispenser housing physically receiving both the front drawer and the rear drawer in the closed positions.

3. The laundry treating appliance of claim 2 wherein the front drawer is substantially equal in width with the dispenser housing.

4. The laundry treating appliance of claim 3 wherein the rear drawer is substantially equal in width with the dispenser housing.

5. The laundry treating appliance of claim 2 wherein the dispenser housing underlies both the front drawer in the closed position and the rear drawer in the closed position.

6. The laundry treating appliance of claim 5 wherein the front drawer has at least a bottom wall and a side wall.

7. The laundry treating appliance of claim 6 wherein the bottom wall at least partially underlies the rear drawer.

8. The laundry treating appliance of claim 5 wherein the one or more treating chemistry chambers of the front drawer comprise one or more open top containers for single dose dispensing and the one or more treating chemistry chambers of the rear drawer comprise one or more bulk treating chemistry reservoirs.

9. The laundry treating appliance of claim 5 wherein the front drawer is a single dose dispenser drawer.

10. The laundry treating appliance of claim 9 wherein the front drawer is configured to receive an amount of a treating chemistry sufficient for a single cycle of operation.

11. The laundry treating appliance of claim 5 wherein the front drawer is configured to receive a powder treating chemistry.

12. The laundry treating appliance of claim 5 wherein the rear drawer is a bulk dispenser drawer.

13. The laundry treating appliance of claim 5 wherein the rear drawer includes at least one bulk treating chemistry reservoir.

14. The laundry treating appliance of claim 13 wherein the at least one bulk treating chemistry reservoir is configured to receive a liquid treating chemistry.

15. The laundry treating appliance of claim 13 wherein the at least one bulk treating chemistry reservoir is configured to receive an amount of a treating chemistry sufficient for multiple cycles of operation.

16. The laundry treating appliance of claim 5 wherein the front drawer is completely removable from the dispenser.

17. The laundry treating appliance of claim 16 wherein the rear drawer is only movable to the opened position when the front drawer is in the opened position or has been completely removed from the dispenser.

18. The laundry treating appliance of claim 16 wherein the rear drawer is completely removable from the dispenser.

19. The laundry treating appliance of claim 18 wherein the laundry treating appliance can be operated with either of the front drawer or the rear drawer completely removed from the laundry treating appliance.

* * * * *